US006672320B2

(12) United States Patent
Rudolfs

(10) Patent No.: US 6,672,320 B2
(45) Date of Patent: Jan. 6, 2004

(54) APPARATUS FOR WASHING DRUMS

(75) Inventor: Don Rudolfs, San Jose, CA (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 10/370,812

(22) Filed: Feb. 20, 2003

(65) Prior Publication Data

US 2003/0150481 A1 Aug. 14, 2003

Related U.S. Application Data

(62) Division of application No. 09/690,047, filed on Oct. 16, 2000, now Pat. No. 6,557,566.

(51) Int. Cl.[7] ..... B08B 3/02

(52) U.S. Cl. ..... 134/167 R; 134/168 R; 134/171; 134/199

(58) Field of Search ..... 134/166 R, 167 R, 134/168 R, 169 R, 171, 198, 199

(56) References Cited

U.S. PATENT DOCUMENTS

| | | | | | |
|---|---|---|---|---|---|
| 3,615,822 | A | * | 10/1971 | Molinari | 134/23 |
| 4,628,972 | A | * | 12/1986 | LaRochelle | 141/91 |
| 5,137,043 | A | * | 8/1992 | Wickham, III | 134/167 R |
| 6,041,797 | A | * | 3/2000 | Casselman | 134/152 |

* cited by examiner

*Primary Examiner*—Randy Gulakowski
*Assistant Examiner*—Joseph L. Perrin
(74) *Attorney, Agent, or Firm*—John R. Ley, LLC

(57) ABSTRACT

A drum washer has a base, a barrel support structure, and a water delivery system. A hollow drum is turned over and placed on the drum washer by inserting a spray head of the water delivery system through a hole in a top cover of the drum and into the interior of the drum. The barrel support structure holds the drum at a fixed angle while water is sprayed from the spray head onto interior surfaces of the drum. The water rinses the interior surfaces of the drum and drains out the hole in the top cover of the drum.

9 Claims, 5 Drawing Sheets

APPARATUS FOR WASHING DRUMS

CROSS-REFERENCE TO RELATED INVENTIONS

This invention is a division of U.S. application Ser. No. 09/690,047 filed Oct. 16, 2000, now U.S. Pat. No. 6,557,566 filed by the inventors herein.

FIELD OF THE INVENTION

This invention relates to washing drums or barrels of the type which typically contain hazardous or dangerous materials, after the materials have been dispensed from the drums. More particularly, the present invention relates to a new and improved method and apparatus for washing the interior of a hollow drum in an easier and safer manner while reducing the amount of water used, by spraying the interior of the drum with a cleaning solution.

BACKGROUND OF THE INVENTION

Drums or barrels are typically used by chemical manufacturers to transport various hazardous, corrosive, or reactive chemicals used in industrial processes. For example hazardous chemicals such as sulfuric acid, hydrochloric acid, hydrofluoric acid and corrosive polishing compounds are shipped in drums to semiconductor fabricators. The drum is typically made of a polyurethane or other plastic material so that the drum material does not react with the chemical retained in the drum.

When the chemical contents are removed from the drum through the bung holes formed in an end cover of the drum, a residue of the chemical remains on the interior surfaces of the drum. It is a typical requirement under department of transportation regulations and health and safety regulations that the drum must be cleaned of the interior residue prior to transportation of the drum on public highways and in public places. A typical requirement is for a triple washing of the drum. The triple washing standard requires the drum to be rinsed on three separate occasions. The three separate washings are regarded as sufficient to clean the drum enough for public transportation.

The typical method of performing the triple washing procedure is to fill the drum completely with water through one of the bung holes. The drum is then turned over to drain the water from the inside of the drum. This process is repeated three times using clean water during each rinse. This process of triple washing the empty drum consumes a relatively large quantity of water. A typical drum holds fifty-five gallon, thus requiring 165 gallons of water to wash using the conventional triple washing method. In addition, it is difficult for a person to turn the drum over once it has been filled with water because of the weight of the water-filled drum. The difficulty of turning over the relatively heavy water-filled drum also raises issues the possibility of human contact with the chemical residue, because of the difficulty in lifting and manipulating the water-filled drum.

These and other considerations pertinent to the previous processes of washing drums which contain chemical residue has given rise to the present invention.

SUMMARY OF THE INVENTION

One aspect of the present invention relates to rinsing the inside of a drum to a level of cleanliness achieved with a triple washing standard by using only a relatively small amount of water compared to the amount of water typically required to fill each drum three times. Another aspect of the invention relates to rinsing the inside of a drum in a manner which does not require the drum to be inverted or otherwise manipulated by human contact while the drum is washed. Yet another aspect of the invention relates to avoiding the necessity to manipulate relatively heavy water-filled drums during washing.

In accordance with these and other aspects, the invention relates to a drum washer apparatus. The drum washer includes a base support structure, a barrel support structure connected to the base structure for supporting the drum in a position in which a top cover of the drum is below a bottom cover of the drum, and a fluid delivery system for delivering cleaning fluid into the interior of the drum. The fluid delivery system includes one or more spray heads which are inserted into one or more bung holes in an end cover of the drum by which to spray the cleaning fluid onto the inside surfaces of the drum. The empty drum is turned over and placed onto the drum washer by inserting spray heads of the drum washer into the interior of the drum through holes in the top cover of the drum. The cleaning fluid spray completely contacts the interior surfaces of the drum, and the spray is maintained for a predetermined amount of time sufficient to thoroughly wash the interior surfaces of the drum. The cleaning fluid which accumulates within the interior of the drum during spraying is allowed to drain from one or more of the bung holes. The cleaning process is preformed three times, each for the predetermined time, and results in a drum that has been cleaned and rinsed sufficiently to satisfy the triple washing standard.

Preferred aspects of the drum washer include wheels mounted to the base structure for providing mobility to the drum washer. The wheels allow the drum washer apparatus and the drum positioned on it to be moved conveniently over a neutralization pit which collects the spent rinse water or washing fluid. The spent washing fluid is typically collected in a holding or neutralization tank where the Ph level (of the water) is adjusted before the water is returned to a city water waste system. The cleaning fluid delivery system may include a spigot valve for controlling the predetermined delivery time of the flow of the water or cleaning fluid to the spray heads. The convenience of the spigot valve facilitates a convenient execution of the three separate washings.

In accordance with these and other aspects, the invention also includes a method for rinsing the inside surfaces of the drum. The drum is placed in a position in which the top cover is below the bottom cover. Water or other washing fluid is delivered through one or more holes in the top cover of the drum and onto the interior of the drum. Inside surfaces of the drum are rinsed and the cleaning fluid is then allowed to drain out one or more of the holes in the top cover of the inverted drum. To preferably the cleaning fluid is sprayed onto the inside surfaces of the drum.

A more complete appreciation of the present invention and its improvements can be obtained by reference to the accompanying drawings, which are briefly summarized below, by reference to the following detailed description of a presently preferred embodiment of the invention, and by reference to the appended claims.

DETAILED DESCRIPTION

Figure 1:
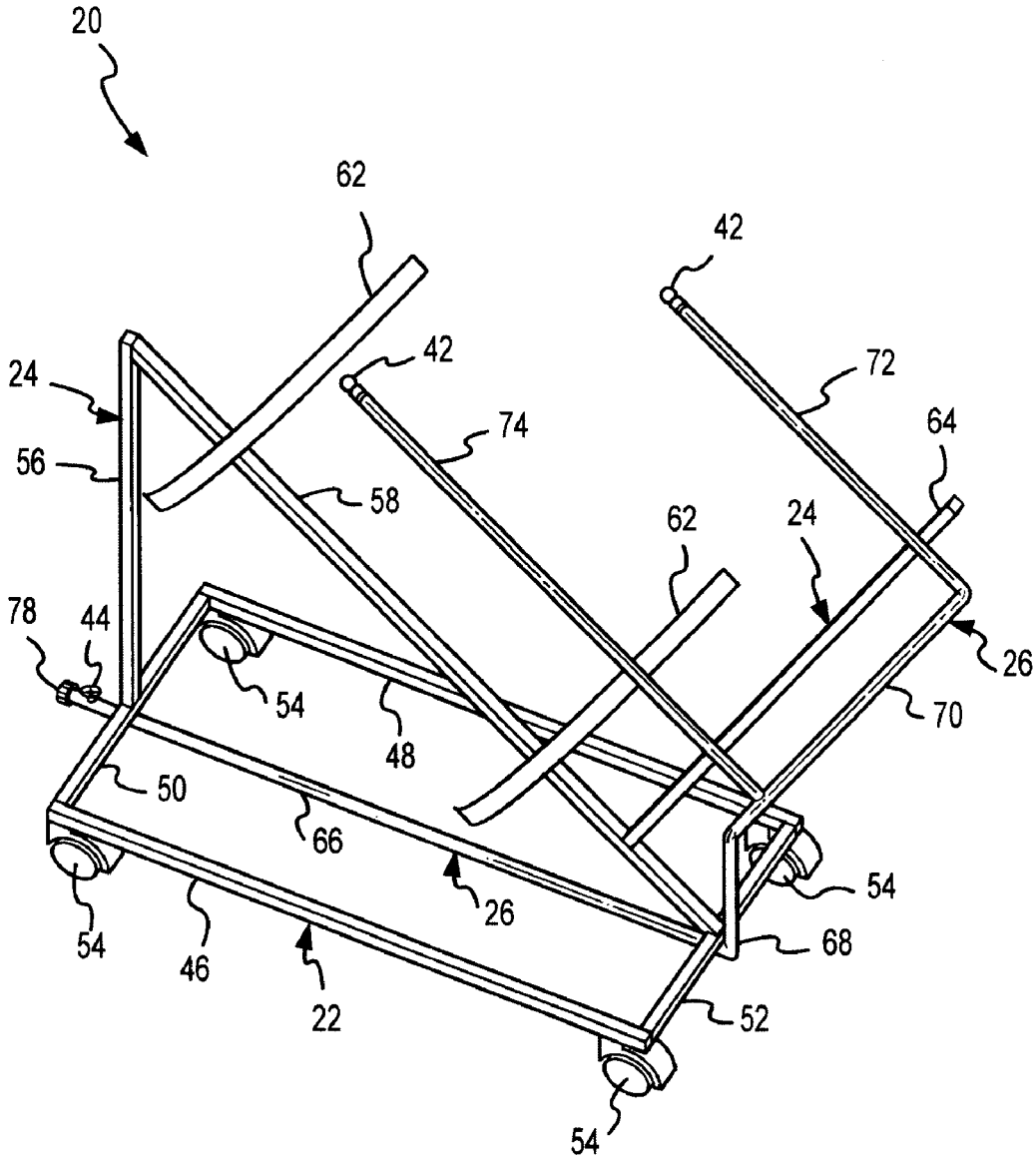
FIG. 1 is a perspective view of a drum washer which incorporates the present invention and which serves as a basis for understanding the methodology of the present invention.
Figure 4:
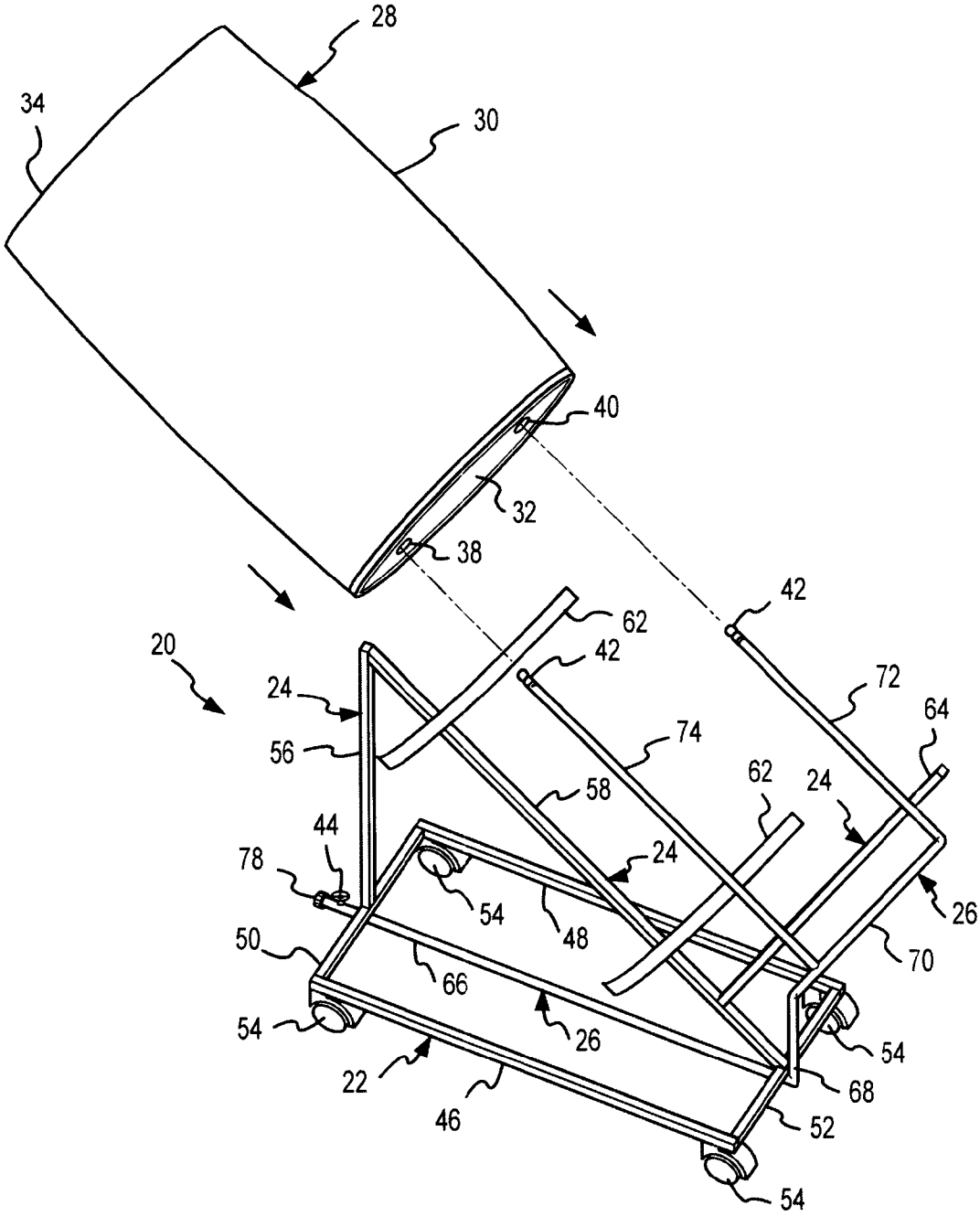
FIG. 4 is a perspective view similar to FIG. 1, also illustrating a drum being positioned on the drum washer shown in FIG. 1.
Figure 5:
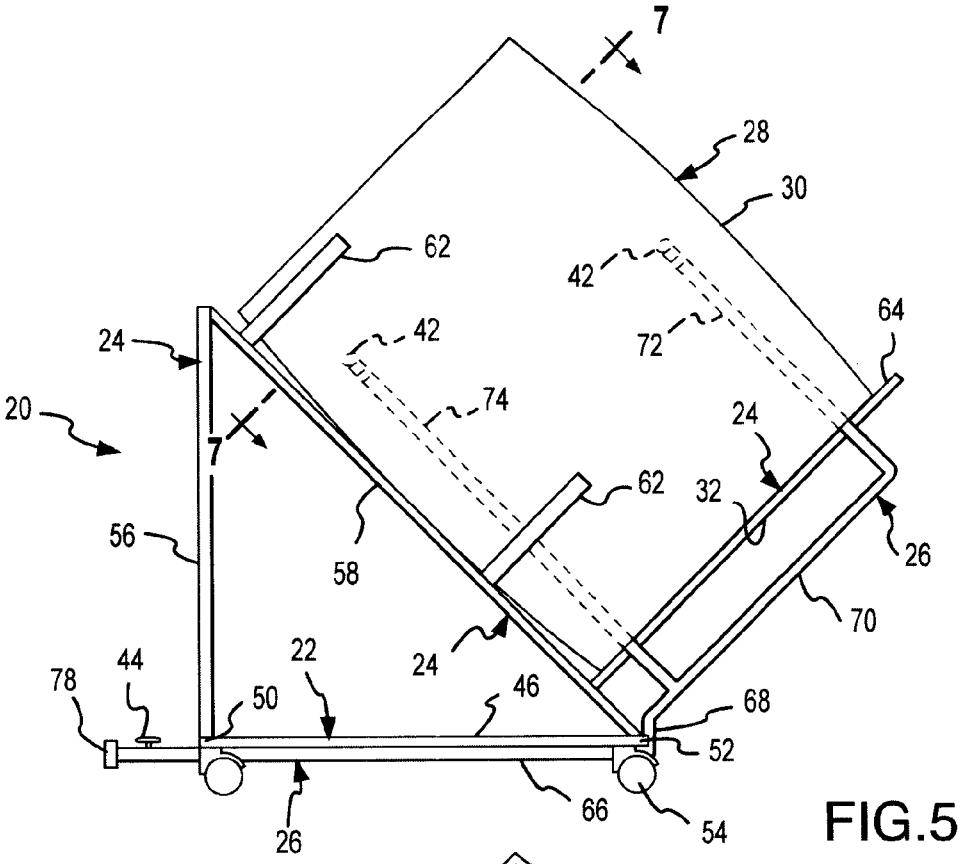
FIG. 5 is a side elevation view of the drum washer and the drum after the drum has been positioned on it as shown by FIG. 4.

A drum washer 20 incorporating the present invention is shown in FIG. 1. The drum washer 20 includes a base structure 22, a drum support structure 24, and a fluid delivery system 26. A hollow drum 28 is placed onto and supported by the drum support structure 24 as shown in FIGS. 4 and 5. The drum 28 is of the typical configuration, which includes a generally cylindrically shaped sidewall 30 and a top end cover 32 and a bottom end cover 34 which connect to the sidewall 30 and thereby define a hollow interior 36 within the drum 28. The top end cover 32 has two bung holes 38 and 40 formed into it. The size, spacing and positioning of the bung holes 38 and 40 in the top cover 32 are standard for most chemical drums.

Figure 6:
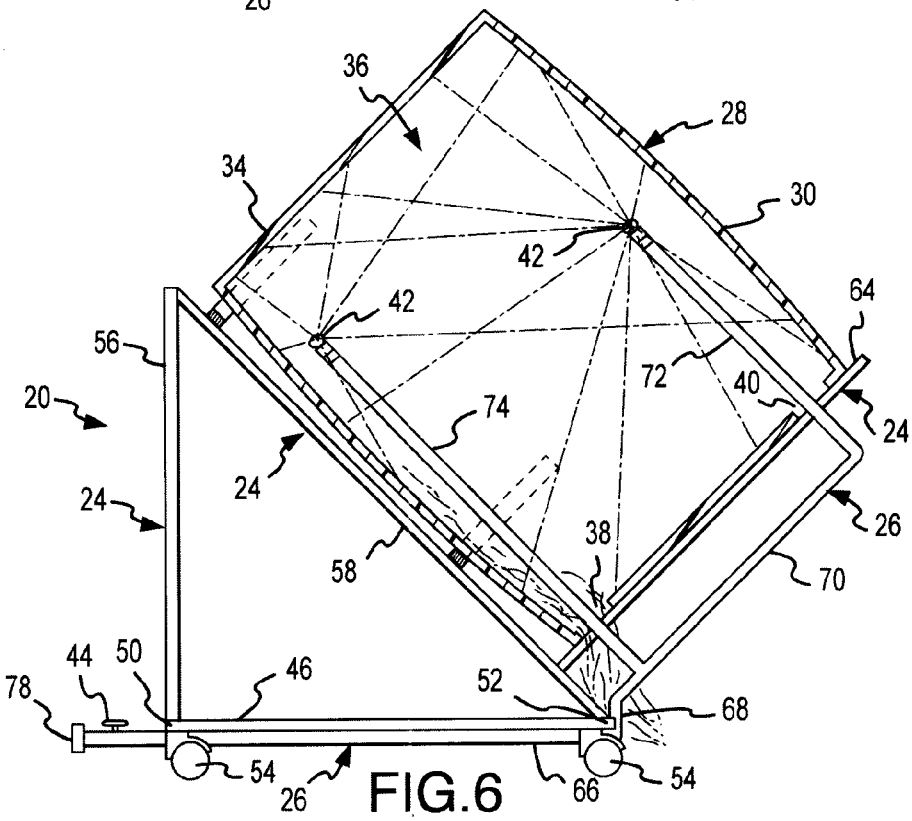
FIG. 6 is a side section view of the drum washer as shown in FIG. 5, taken substantially in the plane of line 6—6 shown in FIG. 7.
Figure 7:
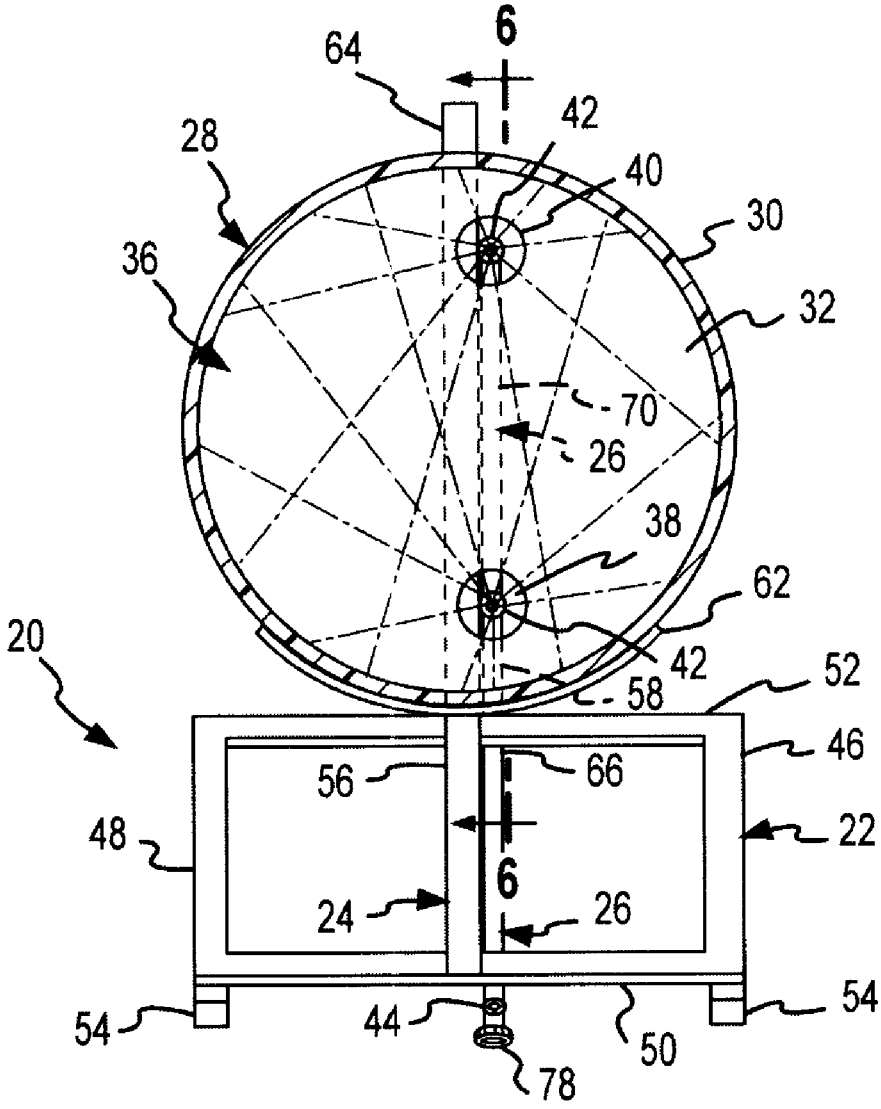
FIG. 7 is an end section view of the drum washer shown in FIGS. 5 and 6, taken substantially in the plane of line 7—7 shown in FIG. 5.

With the drum 28 positioned on the support structure 24 of the drum washer 20, as shown in FIGS. 5 and 6, spray heads 42 of the fluid delivery system 26 extend through the bung holes 38 and 40 and into the interior 36 of the drum 28. A spigot valve 44 of the fluid delivery system 26 controls the delivery of fluid from the spray heads 42. The spray heads 42 direct cleaning fluid into the drum interior 36 and onto the inside surfaces of the sidewall 30 and end covers 32 and 34 to rinse any chemical residue from the interior 36 drum 28 as shown in FIGS. 6 and 7. The washing fluid which accumulates within the interior 30 is allowed to drain from the lower bung hole 38 and into a collection or neutralization pit (not shown) beneath the drum washer 20.

Figure 2:
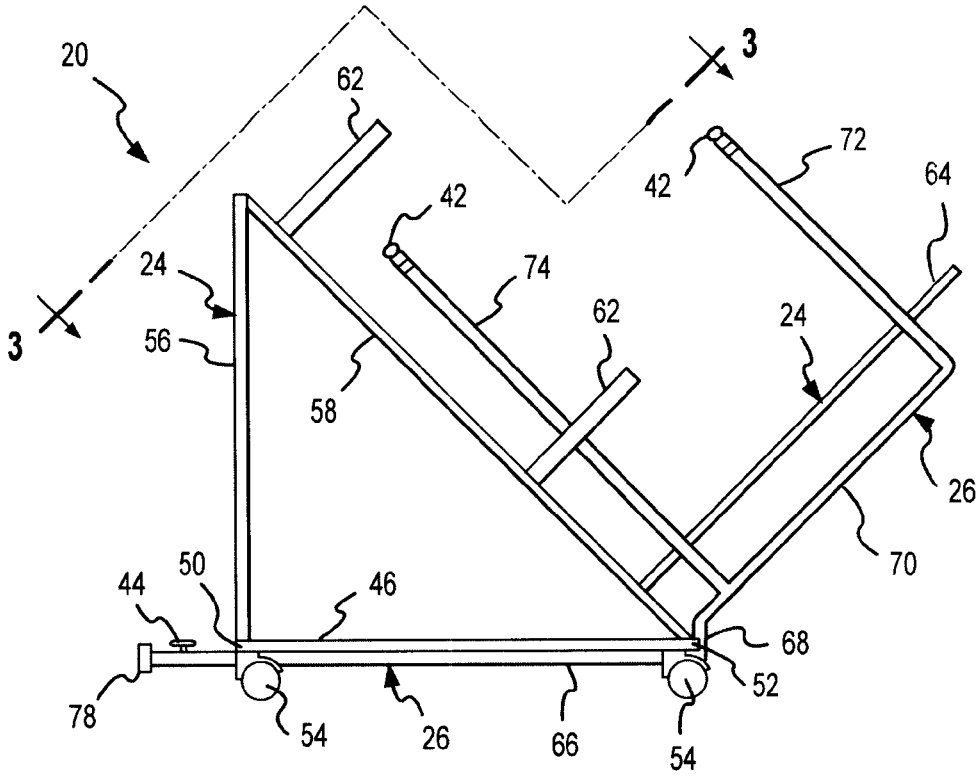
FIG. 2 is a side elevation view of the drum washer shown in FIG. 1.
Figure 3:
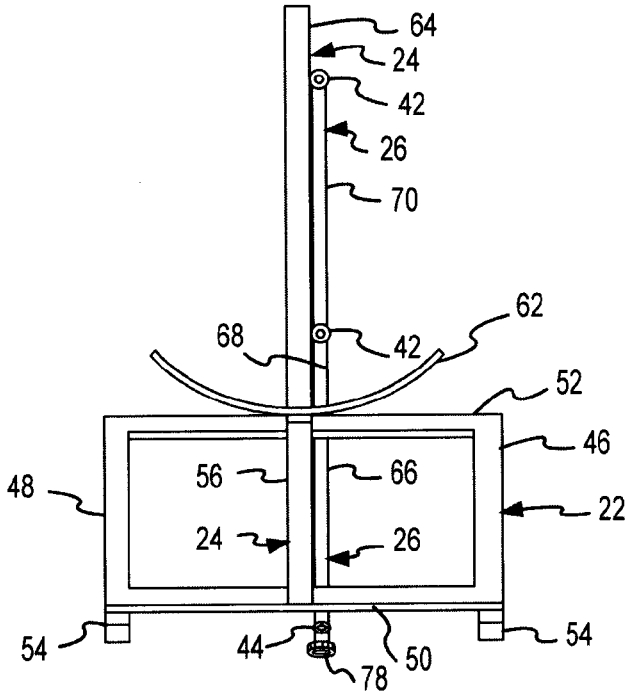
FIG. 3 is an end view of the drum washer taken substantially in the plane of line 3—3 shown in FIG. 2.

More details of the base structure 22 of the drum washer 20 are shown in FIGS. 1–3. The base structure 22 is preferably formed from four elongated frame members 46, 48, 50 and 52 which are joined together at their ends, preferably by welding, to form a rectangularly shaped structure. Also connected at the corners of the base structure 22 are four casters or wheels 54 which are mounted to an underside of the rectangular base structure 22. The four wheels 54 provide mobility to the drum washer 20. For example, the drum washer 20 can be rolled over a collection and neutralization pit (not shown) by using the wheels 54. As another example, the drum 28 can be loaded on the drum washer 20 at one location and then pushed to a washing location using the drum washer 20 as a cart without having to lift the drum and carry it to the washing location. Once the drum washer 20 is above the neutralization pit or washing location, the rinse water or fluid can exit the interior 36 of the drum 28 (see FIG. 6) and flow directly from the drum interior 36 and into the neutralization pit without a contacting the wheels 54, as is appreciated by reference to FIG. 7. The frame members 46, 48, 50 and 52 of the base structure 22 are preferably made of stainless steel to resist corrosion from the chemical residues which are washed from the interior of the drum 28. Similarly, the bearings in the wheels 34 are preferably made of stainless steel although they could also be made with some other non-corrosive material normally used for making bearings.

More details concerning the drum support structure 24 are shown in FIGS. 1–7. The drum support structure 24 includes a vertical support member 56 and an angular support member 58. which extends from the operating end of the vertical support member 56 to the midpoint of the frame member 52. The lower end of the vertical support member 56 is connected to a midpoint of the frame member 50, and the vertical support member 56 preferably extends upwards from this midpoint location in a vertical direction. The upper end of the vertical support member 56 is connected to an upper end of the angular support member 58. The angular support member 58 extends from the upper end of the vertical support member 56 downward to a midpoint of the frame member 52 where the angular support member 58 is connected.

The angular support member 58 supports the weight of the drum 28 and the contents of the drum. Two upward-curved sidewall contact members 62 are mounted to the angular support member 58 at positioned spaced along the length of the angular support member 58. The sidewall contact members 62 extend transversely outward with respect to the angular support member 58 to contact the sidewall 30 of the drum 28 when the drum is positioned on the angular support member 58, as shown in FIG. 5. The sidewall contact members 62 prevent the drum 28 from rolling transversely off of the angular support member 58. The sidewall contact members 62 preferably have a shape which conforms to the sidewall 30 of the drum 28, to support and hold the drum in position during washing. An end stop member 64 is connected to and extends perpendicularly from the angular support member 58 near the lower end of the angular support member. The purpose of the stop member 64 is to prevent the drum 28 from sliding downward along the angular support member 58, as shown in FIGS. 5 and 6. The stop member 64 also helps to support the drum 28 and the weight of the relatively small amount of fluid accumulated within the drum 28 while the drum is being washed.

Preferably, the angular support member 58 forms approximately a 30 degree angle with respect to the horizontal and the base structure 22. Consequently, the drum 28 is supported at a comparable 30 degree angle, with the top end cover 32 positioned below the bottom end cover 34, as shown in FIG. 5. A 30 degree angle is sufficient to allow the fluid accumulated within the interior 36 of the drum 28 to drain from the lower bung hole 38 without accumulating a significant amount of the fluid within the drum 28, as shown in FIG. 6. The elements 56, 58, 62 and 64 of the barrel support structure 24 are preferably made of stainless steel to prevent corrosion of the barrel support structure 24 that may result from contact with the chemical from the drum 28. The elements 56, 60, 62 and 64 are also preferably connected to one another and to the frame members 50 and 52 of the base structure 22 by welding.

Details concerning the fluid delivery system 26 are shown in FIGS. 1–7. The fluid delivery system 26 includes a horizontally extending main pipe 66 and a vertically extending riser pipe 68. The main pipe 66 is connected to the underside of the frame members 50 and 52 of the base structure 22. A manifold pipe 70 connects to the upper end of the riser pipe 68. Delivery pipes 72 and 74 are connected to extend from the manifold pipe 70 in a direction generally parallel to one another and to the angular support member 58. The delivery pipes 72 and 74 are connected to and supported by the end stop member 64 at locations which allow them to extend into the bung holes 38 and 40 when the drum 28 is supported on the drum support structure 24, as shown in FIGS. 4, 6 and 7. The riser pipe 68 and the manifold pipe 70 are retained in position by their connections to the main pipe 66 and the delivery pipes 72 and 74, respectively, and by the connections of the main pipe 66 and the delivery pipes 72 and 74 to the frame members 50 and 52 and the into stop member 64, respectively.

The spray heads 42 are connected to the ends of the delivery pipes 72 and 74. Preferably, the spray heads 42 are conventional stainless steel swivel heads that rotate due to water pressure in the fluid delivery system 26, and while rotating, create a spray which covers the entire inner surfaces of the hollow drum 28. The upper one of the delivery pipes 72 is relatively shorter in length than the lower one of the delivery pipes 74. The relative difference in length of the delivery pipes 72 and 74 causes each of the spray heads 42 to be located at different positions spaced along the axis of the drum 28, as shown in FIG. 6. Consequently, the spray heads 42 are also positioned at different axial locations within the interior 30 of the drum 28. The different positions of the spray heads serves to create two separate source locations for the spray within the interior of the drum, thereby in effect causing the fluid to impact the interior of the drum in two different angular orientations to help dislodge and remove the chemical residue. A more effective cleaning action is achieved by the two separate spray sources which impact from two different angular orientations.

A spigot valve 44 is connected to the end of the main pipe 66, and a hose connector 78 is connected to the spigot valve 44. The spigot valve 44 is connected to the main pipe near the frame member 50 of the base structure 22. When water is the cleaning fluid, the hose connector 78 is a connector for a standard garden hose by which the water is delivered from a conventional water source (not shown) to the fluid delivery system 26.

The pipes 66, 68 and 70 are connected together with conventional elbows and fittings, or a single pipe may be bent to form the individual pipes 66, 68 and 70. The delivery pipes 72 and 74 are connected to the manifold pipe 70 by fittings or by welding. The spigot valve 44 and the hose connector 78 piper are conneted by conventional fittings. The components of the of the fluid delivery system 26 are preferably made of stainless steel to inhibit corrosion resulting from contact with the chemical residue from the drum 28.

To rinse out a drum 28, the hollow drum is turned over and placed onto the drum washer 20 as shown in FIGS. 4 and 5. The spray heads 32 are inserted through the holes 38 and 40 in the top cover 32 of the drum 28 as the drum is positioned onto the drum washer 20. The spray head 42 connected to the longer delivery pipe 74 is inserted into the lower bung hole 38 and the spray head connected to the shorter delivery pipe 72 extends into the upper bung hole 40. The drum 28 is supported by the angular support member 58, the sidewall contact members 62 and the end stop member 64.

After the drum 28 has been placed on the drum washer 20, the spigot valve 44 is turned on to allow water or other cleaning fluid to flow from the source (not shown) though the fluid delivery system 26 and out of the spraying heads 42 as shown in FIGS. 6 and 7. The water or cleaning fluid is directed in all directions toward the interior drum surfaces of the drum 28 and covers the entire interior surfaces of the drum. The water or cleaning fluid which is discharged by the spraying heads 42 accumulates within the interior of the drum, until it eventually exits the drum 28 through the bung hole 38 under the force of gravity.

In order to wash the interior of the drum 28 multiple times, the water or cleaning fluid is turned on using the spigot valve 44 for a predetermined time period and then the supply of water or cleaning fluid is turned off at the spigot valve 44. The water or cleaning fluid accumulated inside the drum 28 is allowed to completely drain from the drum through the bung hole 38. The amount of time that the water or cleaning fluid is allowed to spray into the drum may be selected by empirical study. This process is preferably repeated a sufficient number of times to achieve the desired level of cleanliness of the drum.

As an example of the utility of the present invention, the triple washing standard may be achieved by washing the interior of the drum 28 with twelve gallons of water during each one of three successive one-minute intervals, where the water is allowed to completely drain from the drum between the one-minute intervals. Consequently, one 55 gallon drum can be washed adequately using approximately 36 gallons of water with the present invention, compared to the prior use of approximately 165 gallons of water.

The use of a drum washer to rinse drums is easier and safer than manually filling and emptying the drums because the drums need only to be manipulated by hand with the present invention when they are empty rather than when they are full of water. Once the barrels are positioned on the drum washer 20, they need not be moved until they have been completely washed. Consequently, no human contact with the material drained from the drums is likely. The necessity to manually move drums filled with water is avoided, which is significant because they 55 gallon drum filled with water may weigh in excess of 400 pounds. Injury from moving water-filled drums is avoided. Of course, the amount of water used in washing the drums is substantially less than the manual filling technique, particularly in achieving the triple rinsing standard. Many other advantages and improvements will be apparent after gaining an understanding of the present invention.

The presently preferred embodiments of the present invention have been shown and described with a degree of particularity. These descriptions are of preferred examples of the invention. In distinction to its preferred examples, it should be understood that the scope of the present invention is defined by the scope of the following claims, which should not necessarily be limited to the detailed description of the preferred embodiments set forth above.

The invention claimed is:

1. A drum washer for rinsing inside surfaces of a substantially hollow drum, having an interior defined by a side wall, a bottom cover at one end of the side wall and a top cover at another end of the side wall the top cover having first and second holes providing access to an interior of the drum, the drum washer comprising:

a base structure;

a drum support structure connected to the base structure and having a configuration to contact the side wall and to support the drum in a rinse position in which the top cover is located below the bottom cover;

a water delivery system connected to the base structure and operative to deliver water into the interior of the drum, the water delivery system including first and second generally parallel delivery pipes each having a different length and also including first and second spray heads connected to each of the first and second delivery pipes for spraying water from the first and second delivery pipes, respectively, the delivery pipes oriented relative to the drum support structure to project into the first and second holes when the drum is supported on the drum support structure in the rinse position, the first and second delivery pipes oriented to extend substantially parallel with the side wall of the drum when the drum is supported on the drum support structure in the rinse position, respectively, the different lengths of the first and second delivery pipes extending into the interior of the drum, different distances from the top cover when the drum is supported on the drum support structure in the rinse position, and the first and second spray heads spraying water from the first and second delivery pines, respectively, within the interior of the drum at two different distances from the top cover.

2. A drum washer as defined in claim 1, wherein the drum support structure contacts and holds the drum at approximately a 30 degree angle with respect to horizontal.

3. A drum washer as defined in claim 1, further comprising:

casters mounted to the base support structure to allow the drum washer to be moved by rolling.

4. A drum washer as defined in claim 1, further comprising:

a valve for controlling a flow of the water to the spray heads.

5. A drum washer as defined in claim 4, wherein the drum washer further includes first and second ends, and when the drum is supported in the rinse position on the drum support structure the top cover of the drum is closer to the second end of the drum washer than is the bottom cover, and wherein the valve is connected to the water delivery system at the first end of the drum washer.

6. A drum washer as defined in claim 1, wherein the first and second spray heads are rotatable to spray water within the interior of the drum.

7. A drum washer as defined in claim 6, wherein the first and second spray heads are rotatable with respect to the delivery pipes by applying water pressure to the water delivery system.

8. A drum washer as defined in claim 1, wherein:

the drum support structure comprises first and second side wall support members to contact the sidewall of the drum to support the drum in the rinse position on the drum support structure.

9. A drum washer as defined in claim 1, further comprising:

an end stop member attached to the drum support structure to engage the top cover of the drum and establish a predetermined distance to which the delivery pipes extend into the interior of the drum.

* * * * *